US007339457B2

(12) United States Patent
Trochesset

(10) Patent No.: US 7,339,457 B2
(45) Date of Patent: Mar. 4, 2008

(54) REMOVABLE CAP WITH TIMED SIGNALING FUNCTION

(76) Inventor: Michael A. Trochesset, 2107 Marin, Carrollton, TX (US) 75006

( * ) Notice: Subject to any disclaimer, the term of this patent is extended or adjusted under 35 U.S.C. 154(b) by 476 days.

(21) Appl. No.: 10/495,326

(22) PCT Filed: Jun. 5, 2003

(86) PCT No.: PCT/US03/17789

§ 371 (c)(1),
(2), (4) Date: May 10, 2004

(87) PCT Pub. No.: WO2004/108476

PCT Pub. Date: Dec. 16, 2004

(65) Prior Publication Data

US 2006/0220818 A1 Oct. 5, 2006

(51) Int. Cl.

| | |
|---|---|
| ***G08B 1/00*** | (2006.01) |
| ***A61J 1/03*** | (2006.01) |
| ***B65D 55/02*** | (2006.01) |
| ***B65D 5/00*** | (2006.01) |

(52) U.S. Cl. ..... 340/309.7; 215/201

(58) Field of Classification Search .....
340/309.16–309.9, 457, 502; 368/10; 215/200–364
See application file for complete search history.

(56) References Cited

U.S. PATENT DOCUMENTS

| | | | | |
|---|---|---|---|---|
| 4,367,955 | A * | 1/1983 | Ballew | 368/10 |
| 4,419,016 | A * | 12/1983 | Zoltan | 368/10 |
| 5,577,335 | A * | 11/1996 | Tucker | 40/311 |
| 6,084,504 | A * | 7/2000 | Rosche et al. | 340/309.7 |
| 6,169,707 | B1 * | 1/2001 | Newland | 368/10 |
| 6,545,592 | B2 * | 4/2003 | Weiner | 368/10 |

* cited by examiner

*Primary Examiner*—Benjamin C. Lee
*Assistant Examiner*—Jennifer Mehmood

(57) ABSTRACT

A cap (10) for closing a medicinal container (5) comprises a signal driver for emitting an audible (40) and/or visible (35) signal, a control circuit for timing or calculating a predetermined fixed time interval and then commanding the signal driver to emit its signal; a power source (15) for providing power to the signal driver and the control circuit; and a switch (20) disposed suitably on the cap for sensing the opening and closing of the cap (10). When the switch (20) is first cycled, the control circuit commands the signal driver to emit a verification signal; when the switch (20) is second cycled, the control circuit again commands the signal driver to emit a verification signal; and thereafter, when the switch (20) is opened a third time, the control circuit will begin timing its predetermined fixed time interval. At the end of every interval, the control circuit commands the signal driver to emit its normal alert signal.

9 Claims, 4 Drawing Sheets

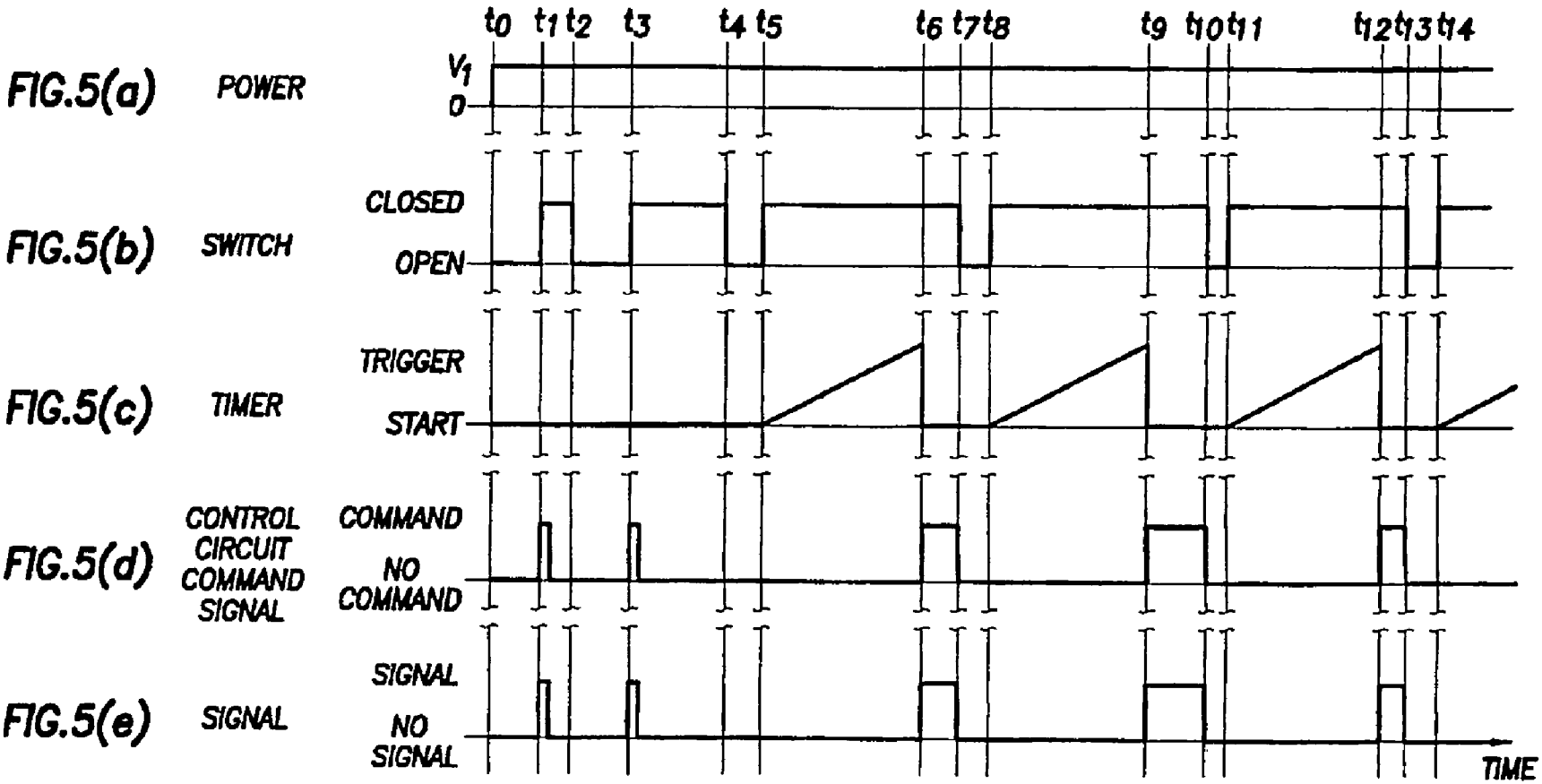
t0 t1 t2 t3 t4 t5 t6 t7 t8 t9 t10 t11 t12 t13 t14
TIME
FIG.5(a) POWER
V1
0
FIG.5(b) SWITCH
CLOSED
OPEN
FIG.5(c) TIMER
TRIGGER
START
FIG.5(d) CONTROL CIRCUIT COMMAND SIGNAL
COMMAND
NO COMMAND
FIG.5(e) SIGNAL
SIGNAL
NO SIGNAL

REMOVABLE CAP WITH TIMED SIGNALING FUNCTION

FIELD OF THE INVENTION

This invention relates to the field of pharmaceutical containers having a cap containing a timer and an audible and/or visual signaling means to alert a person that it is time to consume the medication in the container.

BACKGROUND OF THE ART

Many people need to take medication at prescribed intervals. These intervals may range from two hours or less, up to several weeks. Some people find it difficult to remember to take their medication at the appropriate time. Adverse health consequences can result from forgetting or delaying the consumption of medication. People may forget or delay the consumption of drugs because of advanced age, senility, or loss of memory due to disease. In particular, some persons find it necessary to take medication on a continual basis throughout their life. Even persons who are normally not forgetful may occasionally forget their medication because they become busy or just from normal human forgetfulness.

It would be desirable if there were a simple, reliable means for reminding people to take their medicine at the proper time. There have been attempts in the past to incorporate into the cap of a container of medicine a means for reminding people to take the medicine.

U.S. 2002/0126585 to Osberg et al describes a prior art device that incorporates within a cap a clock that displays to the user the amount of time elapsed since the cap was last removed. The clock is automatically reset by removing and replacing the cap on its container. While this device tracks the time elapsed since medicine was last taken, it does not signal the user to take the next dose and the user may forget or delay the next dose.

U.S. Pat. No. 5,953,288 to Chappell describes a prior art device that incorporates within a cap a clock that displays the time and date that the cap was last removed, allowing the user to see when medication was last taken. The user is not reminded when the next dose is due to be taken.

Other prior art devices are user-programmable and will signal the user when a programmed time has elapsed. These programmable units are too complex for some users to program properly. For example, people with arthritis and poor vision may find it difficult to see the programming mechanism and operate it successfully with arthritic hands. Pharmacists may be reluctant to provide these caps to some people and they may be commercially unviable for this reason.

There has been a long-felt need in this art for a device usable with containers of medicine that will reliably signal the user each time medication should be taken and which is very simple and reliable to use. Preferably, the device should reliably operate without any control inputs from the consumer; and only a simple choice and verification by the pharmacist. There has been a need in the art for a cap with a timed signaling function that is reliable, easy to dispense, and relatively simple to manufacture.

As used in this patent application, the word "cap" designates any means used to close any commercially-available pharmaceutical or medicinal container, bottle or vial, including those that incorporate a so-called "child-resistant" or "child-proof" mechanism. Caps may be of the screw-on variety, pop-on variety, or may be of the twist-and-lift variety. The cap may or may not be attached to the vial in some manner. However, the word "cap", as used herein, is not limited to only these types of caps.

BRIEF SUMMARY IF THE INVENTION

The invention comprises a cap or a means for closing a container, the cap or means for closing comprising a signal means for emitting an audible and/or visible signal to a person, a control circuit means for timing or calculating a pre-set time interval and then commanding the signal means to emit its signal, a power source for providing power to the signal means and the control circuit means, and a switch means disposed at a suitable location on the cap for sensing the opening and closing of the cap. The control circuit means is arranged so that after power is first applied and the switch means is first cycled, it will command the signal means to emit a short verification signal; when it is second cycled, it will again command the signal means to emit a short verification signal; and thereafter, when the switch is opened and closed a third time, the control circuit means will begin calculating its pre-set time interval and, at the end of every subsequent interval, the control circuit means will command the signal means to emit its normal signal to alert the user that it is time to take his or her medication. When the user removes the cap from the container, the switch means will cause the control circuit means to command the signal means to cease any signaling. The removal and replacement of the cap by the user causes the control circuit means will again start calculating its pre-set time interval. The invention is substantially contained within the cap. The switch means is suitably located at a location on the cap such that it is cycled when the cap is opened and then closed on the container. The switch means is connected to the control circuit so that the control circuit senses when the cap is removed or replaced on the container.

This invention may be used with any type of pharmaceutical or medicinal container or vial, whether it is used to hold solid, powder, or liquid substances. This invention may be incorporated into any type or style of cap for a pharmaceutical or medicinal container or vial, including those that have so-called "child-resistant" or "child-proof" top mechanisms. I believe that it would be a simple matter to adapt the on-off switch disclosed herein into any commercially-available top so that it functions properly for this invention.

By providing a cap which times a pre-set time interval and then signals the user, the pharmacist may stock in the pharmacy a group of caps having different time intervals. If a customer's prescription calls for pills that are to be taken, for example, every two hours, the pharmacist can simply grab a cap whose time interval is two hours, cycle the cap to obtain a verification signal that it is properly working, and then attach the cap to the filled vial. When the customer takes his or her first dose, the first removal and replacement of the cap will cause the cap to begin timing its two-hour time interval and it will signal the user at the end of each subsequent two-hour time period after the medicine is consumed. The pharmacist and the customer are then relieved of the need to program a time interval into a programmable cap, and the customer can reliably be reminded to take the medicine.

BRIEF DESCRIPTION OF THE DRAWINGS

FIG. 5 shows a timing diagram that helps explain the operation of the preferred embodiment.

DETAILED DESCRIPTION OF THE PREFERRED EMBODIMENT

A common pill vial has a removable cap or closing cover. The removable cap may be removed or opened from its associated container in any manner: it may screw on and off, or it may be of the "press and turn" variety, or it may "pop" on and off, or it may be removably attachable in any other known fashion. The particular type of cap used is not relevant to this invention. It is possible to adapt the on-off switch disclosed herein to any type of removable cap or closing cover, and my invention is meant to include any such removable/openable cap or closing cover.

Figure 1:
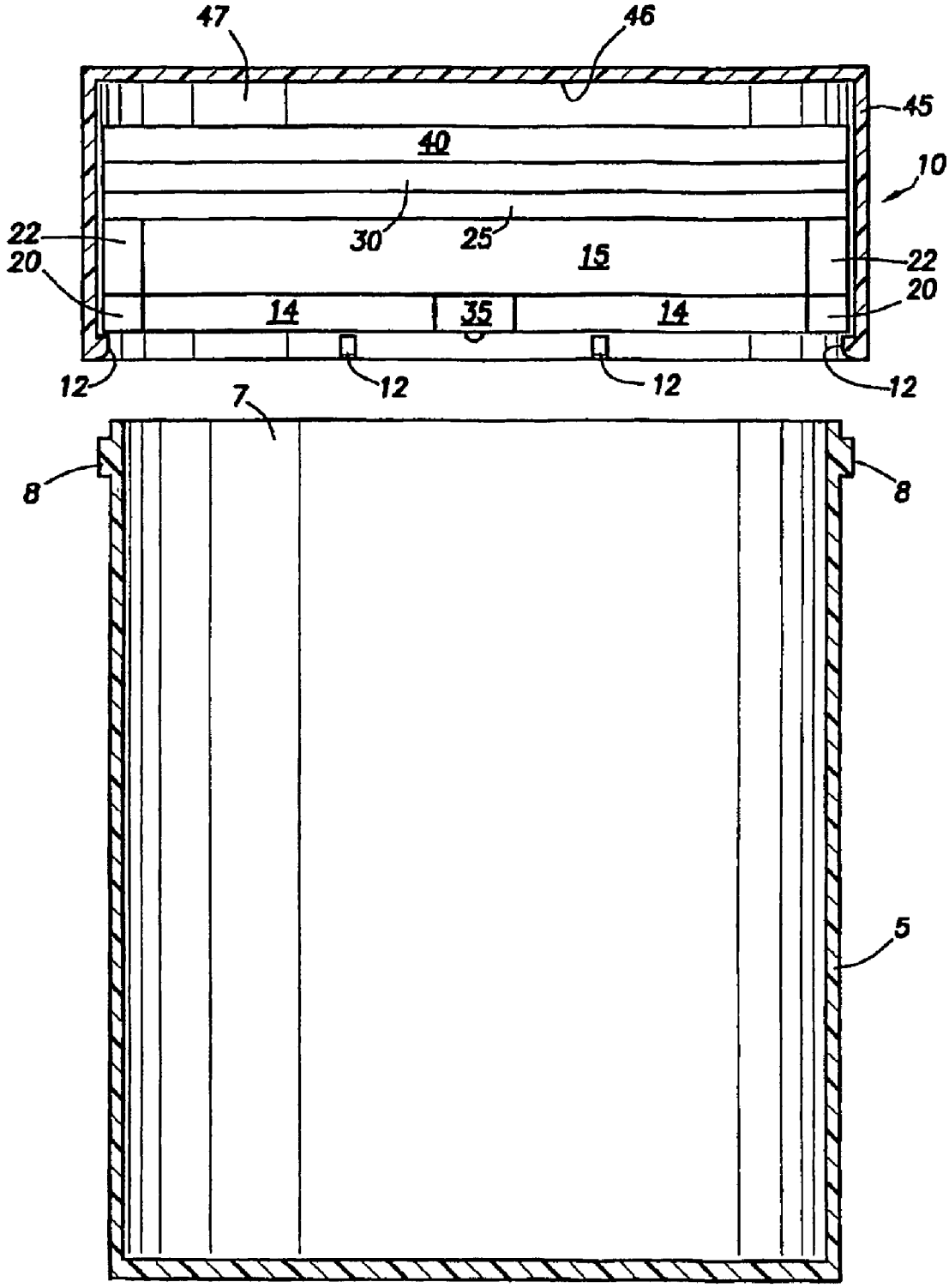
FIG. 1 shows schematically a cut-away side view of the preferred embodiment of this invention.

A mechanism for timing, control, and signaling is located substantially within the cap. FIG. 1 shows schematically a cut-away side view of the preferred embodiment of this invention. In this embodiment, a common pill vial 5, open at its top 7, is covered by a removable and replaceable cap 10. The pill vial 5 has typically six attachment flanges 8 disposed near its top and around its outer circumference. The cap 10 removably attaches to the open top 7 of the vial 5 so as to securely cover the vial 5 and contain its contents. Situated within the cap 10 is the mechanism for timing, control, and signaling.

The timing, control, and signaling mechanism comprises a power source 15, at least one switch 20, a control circuit 25, a signal driving means 30, an LED 35 for visible signaling, and a speaker 40 for audible signaling. Each of the components is disposed within a cap body 45. The body 45 of the cap is typically molded plastic, and physically holds the other elements of the cap. The various components are chosen and sized to minimize the size and weight of the cap while maintaining suitable durability and reliability.

The body 45 of the cap 10 has typically six attachment flanges 12 disposed at or near the open bottom of the cap. These flanges 12 correspond and cooperate with the six attachment flanges 8 of the vial 5 to securely hold the cap on the vial when it is attached to the vial, as is well known in this art.

The timing, control, and signaling mechanism is an integrated unit that is assembled separately from the cap body 45, and then inserted through the flanges 12 and into the interior of the cap body 45, as is well known in this art. The preferred embodiment of FIG. 1 is shown to have two switches 20 disposed on opposite sides of the mechanism and at the bottom of the cap. The switches are normally open. The switches are housed in a pliable or flexible material (not shown), so that when the cap 10 is attached to the vial 5, the top edge of the vial presses firmly up against the one or more switches 20, thereby closing the switches 20.

The switch 20 can be located on the inside portion of the cap 10 at any suitable point where the cap 10 contacts the vial 5 when the cap is attached to the vial. However, my invention is not limited to any particular location of the switch 20. Any location on the cap that contacts the vial or container when it is replaced could serve as a location for the switch. All that is required is that removal of the cap 10 from its container 5 cause the switch 20 to open, or otherwise change state; and that replacement of the cap 10 onto its container 5 cause the switch 20 to close, or otherwise change state. The switch could be arranged to either open or close when the cap is removed and then either close or open when the cap is replaced. Although two switches are present in the preferred embodiment, it is possible to use one switch, or more than two switches. If two or more switches are used, the control circuit should be arranged so that signaling is possible if only one of the multiple switches has been closed.

The switch 20 is typically a leaf-spring on-off switch so that, when the cap 10 is attached to the top of the vial 5, the outer top portion of the vial is pressed against the leaf of the leaf-spring switch, forcing it down and closing the switch, thereby allowing power to flow from the power source 15 to the control circuit 25. However, my invention is not limited to this particular type of switch. Although an on-off switch is the most simple type of switch, it is possible to utilize other types of switches. The switch might be mechanical or non-mechanical, including (but not limited to) fluid, electronic, and photonic switches. Any switch that will enable the control circuit to sense that the cap 10 has been removed and replaced is within the scope of this invention.

The mechanism includes an LED 35 with its light emitting lens pointed generally downwards toward the vial 5. The LED 35 may be disposed at the center portion of the open bottom of the cap. Leads 13 for supplying electrical power to the LED 35 may run through spaces 14 surrounding the LED. The LED 35 is securely attached to the mechanism. Leads for connecting the switches 20 to the control circuit 25 may run through open space 22 surrounding the power source 15, which may be of a diameter somewhat less than the interior diameter of the cap body 45.

The control circuit 25 and the signal driving means 30 are powered by the power source 15. The power source 15 may be any suitable power source with an output voltage and power output that is suitable for driving the control circuit 25 and the signal driving means 30. The power source 15 is typically a low-voltage, watch-type battery. The battery can be mounted in the cap such that either it is accessible and replaceable, or inaccessible and non-replaceable. In the preferred embodiment, the battery is inaccessible and non-replaceable. The control circuit 25 is an integrated circuit which will typically comprise a timing circuit, and a command signal generator (neither shown) whose output is connected to the signal driving means 30. The control circuit receives power from the power source 15.

The timing, control, and signaling mechanism is somewhat loosely held within the body 45 of the cap 10. In FIG. 1, in the orientation depicted, gravity has caused the mechanism to move toward the open bottom of the cap 10 and the mechanism is held in the cap 10 by the flanges 12. When the mechanism has moved to the bottom, there will be an open space 47 between the top of the speaker 40 and the inside of the top segment 46 of the cap body 45. At such time as the cap 10 is attached to the vial 5, the top edge of the vial will press against the mechanism and, in particular, the switches 20, and cause the mechanism to be moved to the inside of the top surface 46 of the cap body 45. When the mechanism is firmly pressed up against the top surface 46, the top edge of the vial 5 will still press firmly up against the bottom of the mechanism and, in particular, against the switches 20, causing the switches to close and remain closed for as long as the cap 10 remains attached to the vial 5.

Figure 2:
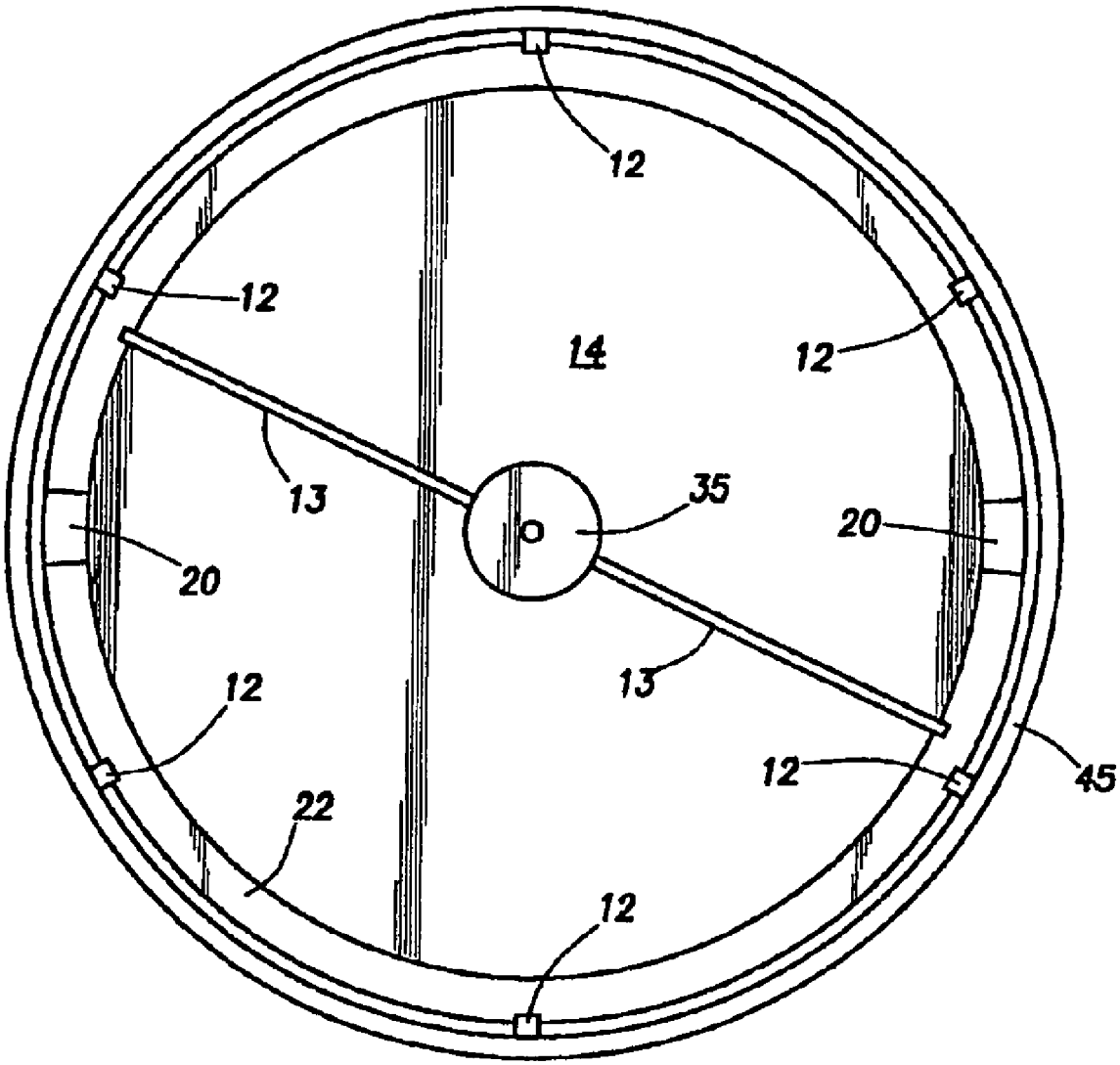
FIG. 2 shows an open view of the preferred embodiment from the bottom of the cap.

While two switches 20 are shown in FIGS. 1 and 2, the number of switches used is a matter of design choice. The use of the words "switch" or "switches" in this description should be understood to refer to the particular number of switches chosen, whether it be one or more.

FIG. 2 shows another view of the cap from its open bottom. In this view, the circumference of the bottom of cap body 45 is shown to contain the mechanism by means of six flanges 12. This view shows the LED 35 in the center with two leads 13 electrically connecting it to the control circuit (not shown in this figure). The two switches 20 can be seen on opposite sides of the mechanism. The switches are relatively small, and most of the bottom of the view shows the open space 14 below the power means 15. Around the outer circumference of the mechanism, there are open spaces 22.

Figure 3B:
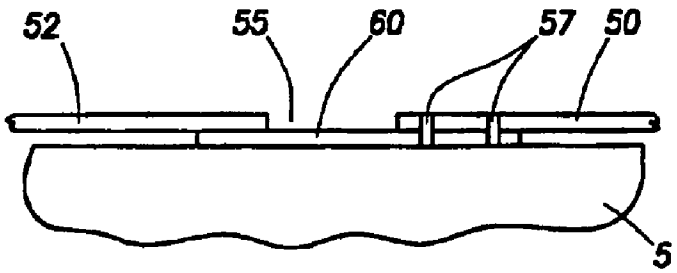
FIGS. 3(*a*) and 3(*b*) show the operation of the on-off switch of the preferred embodiment.
Figure 3A:
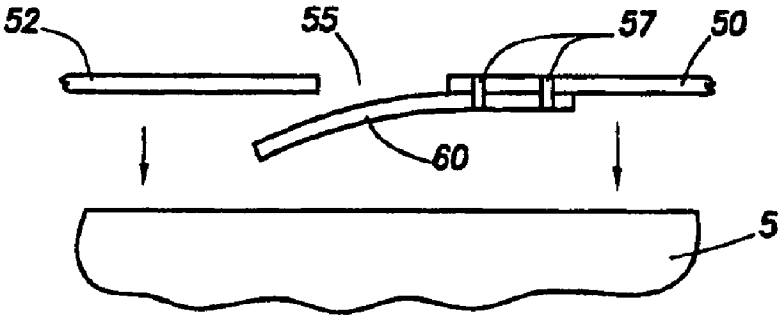

FIG. 3, which consists of FIGS. 3(*a*) and 3(*b*), shows details of the switch 20 used in the preferred embodiment. In FIG. 3(*a*), the switch is shown to comprise a known leaf spring on-off switch. Two electrically-conductive leads 50 and 52 are separated by a gap 55 so that electricity does not flow between the leads. Attached to the lead 50 is an electrically-conductive leaf 60, which is attached to lead 50 by two means of attachment 57, such as rivets or brads or solder points. The conductive leaf 60, as can be seen in FIG. 3(*a*), is normally in an "open" position with the conductor somewhat curved and not in contact with conductive lead 52. When, as seen in FIG. 3(*b*), a force external to the switch 20 presses against the switch, conductive leaf 60 is forced against lead 52, thereby electrically closing the gap 55 between the leads and allowing current to flow unimpeded from lead 50 to lead 52. When the external force is released, conductive leaf 60 naturally returns to its open curved position.

In FIGS. 3(*a*) and 3(*b*), the force that presses conductive leaf 60 against lead 52 is symbolically shown as the top edge of vial 5. However, in practice, switch 20 would preferably be encased in a pliable or flexible housing to protect it from damage. The housing is not shown in FIG. 3 for the purpose of clarity.

The particular switch shown in FIG. 3 is only an example of a type of switch which will work well in the preferred embodiment. There are many other types of switches that will work equally well. My invention is not limited to switches of the on-off type, or to two poles. Any switch which can be suitably positioned on the cap and which will change its state when the cap is attached to its associated container comes within the concept of this invention.

When the programmed or predetermined fixed interval of time has elapsed, the control circuit 25 will immediately begin timing the next interval of time, and will simultaneously command the signal driving means 30 to drive an audible and/or visible signal to emit their signal(s). Typically, the signaling means will consist of a audible tone generator, such as speaker 40, and a light source, such as an LED 35. The battery will send power to a suitable capacitor (not shown) disposed in the signal driving means 30 at all times. The capacitor stores up a charge over time. When the signal driving means 30 is commanded to drive the speaker 40, the signal driving means 30 will periodically cause the capacitor to be discharged into the speaker 40, generating the brief audible tone of a volume that can be heard by the user at a reasonable distance. The audible tone can be generated periodically in the manner of a beeping interspersed by short periods of silence. Short periodic bursts of sound will conserve battery life while still providing an effective signal to the user. For example, the audible signal generator could be set to emit two short tones separated by a half of a second (a double beep) and then remain silent for 30 seconds or a minute, followed by subsequent double beeps. My invention is not limited to this particular beep pattern or to any particular sound; any suitable sound or pattern of sound that attracts the attention of the user is within the scope of this invention.

The speaker 40 of the audible signal generator can be located at any suitable point in or on the cap. In the preferred embodiment, the speaker 40 is located just below the top portion of the cap body 45 and aimed at the top portion, so that the sound emitted from the speaker will impact the top portion and cause it to vibrate and transmit the sound into the ambient. However, it is possible to locate the speaker on the underside of the cap, pointed up at one or more small holes in the top surface of the cap. By this orientation, the sound can travel through the hole or holes and up and away from the vial cap. My invention is not limited by the particular placement of the speaker. Any type of sound-generating means can be placed at any location in or on the cap and, as long as it can generate an audible sound, it is within the scope of this invention. Further, it is possible to not utilize an audible signal generator and to rely solely on a visible signal generator, or vice versa. The use of only one signal means will conserve battery life.

Any suitable light source that generates sufficient light and does not consume too much power can be used as the light source. In the preferred embodiment, an LED 35 is utilized. The signal driving means 30 receives power from the power source 15, stores the incoming power in the form of a capacitive charge in the signal driving means 30. When the signal driving means 30 is commanded to drive the signaling means, it causes the discharge of the capacitive charge into the LED 35 to produce a brief light signal. The light signal would preferably be emitted in the form of single short flashes, separated by longer periods of no light emission, in order to conserve battery power. However, this invention is not limited to any particular light emission timing. Any timing pattern of light emission, including a continuous emission of light, is within the scope of this invention.

The LED 35 may be located at any suitable point on the vial cap. I have discovered that a desirable location and orientation for the LED is for it to be located on the underside of the mechanism pointed generally downwards toward the vial 5 (when the cap 10 is attached to the vial 5). This orientation is best seen in FIG. 1. By this orientation, the flashing of the LED 35 when activated will cause the light emitted to be lensed though the vial 5, which is typically made of colored semi-transparent plastic. The plastic vial, with its round curved side walls, has been discovered by me to act as a lens and diffuse the light so that it is easily seen from almost any angle from the capped vial. However, in such case where the vial 5 will not be transparent, or where the vial has a paper instructions or anything else substantially around the side walls of the vial, or where the medicine filling the vial may fill the vial so full as to block light originating from the bottom of the cap, then it may be more desirable to locate the LED on the top outer portion of the cap and orient it so that it extends slightly above the top surface of the cap. In this position and orientation, the flash of light emitted from the LED will be visible from 360 degrees horizontally around the cap, and at least 180 degrees vertically around the cap.

All of the mechanism of the invention is preferably substantially disposed inside the removable cap 10; the switch 20 being situated at a suitable location on the inside of the cap and extending outwardly slightly so as to cooperate with the container when the cap is attached to the container.

The particular layout of the elements described in the preferred embodiment is not limiting to this invention. The relative order, locations, and sizes of the battery 15, the control circuit 25, the signal driving means 30, the speaker 40 and the LED 35 are a matter of design choice.

Figure 4:
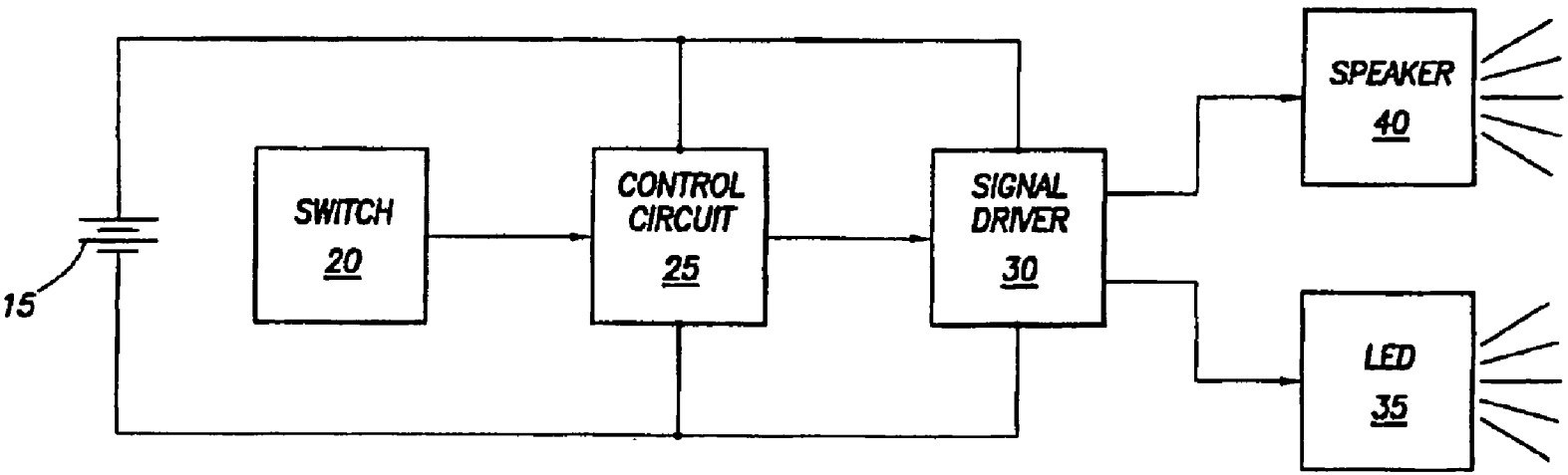
FIG. 4 shows a circuit diagram of the preferred embodiment.

In FIG. 4, a circuit diagram of the preferred embodiment is shown. The preferred embodiment includes a speaker 40 and an LED 35, providing respectively an audible and a visible signaling function to alert the user that it is time to take his/her medicine. The speaker 40 and the LED 35 are both driven by the signal driver 30. Power to operate the signal driver 30 and drive the speaker 40 and LED 35 comes from battery 15 which is connected to the signal driver 30. The signal driver 30 will conserve battery power by charging one or more capacitors within the signal driver 30 during periods when no signal is given. When the signal driver 30 is commanded to generate a signal, it will momentarily discharge stored power from its one or more capacitors into the speaker 40 and the LED 35, thereby causing a short tone and flash of light respectively. The short tone and flash of light will be repeated at particular intervals for as long as the signal driver 30 is commanded to drive the signal means.

The signal driver 30 is controlled by control circuit 25. The control circuit 25 is powered by battery 15. Battery 15 may be connected to both the control circuit 25 and the signal driver 30 in electrical parallel. The control circuit senses the opening and/or closing of the cap 10 to its associated container 5 by means of switch 20. The opening or closing of the cap to its associated container will cause the switch to electrically open or close, and the flow of current, or cessation of current, through the switch is sensed by the circuit of the control circuit 25. The openings and closings of the cap will cause the control circuit to either (1) do nothing until the next opening or closing of the cap, or (2) cause the control circuit 25 to command the signal driving means 30 to drive the signal means.

In operation, when power is first applied to the control circuit (when a battery is inserted and the switch closed) by the assembler of the vial cap, the control circuit will immediately send a command signal to the signal means, which will cause it to be activated, typically giving only two beeps and/or two flashes. This can be called an acknowledgement signal, since its purpose is to acknowledge the cycling of the switch and verify the working of the system. The assembler would close the on-off switch by either attaching the cap to an appropriate jig, or by manually manipulating the switch. This allows the assembler to ensure that the cap is working and has been activated. The assembler then causes the on-off switch to be positioned in the "off" position and the cap will then be shipped to the pharmacist A typical pharmacist will obtain and use groups of caps 10 where each group has a different pre-programmed time period. When the pharmacist has a customer who might need to be reminded to take his or her medicine, the pharmacist will choose a cap with the proper pre-programmed time period from the group of caps with that time period. The pharmacist, then, does not need to spend time programming anything. He just chooses the proper cap.

When the pharmacist chooses to use the proper cap to close the vial (when he/she dispenses pills into the vial), the pharmacist will attach the cap onto the vial, thereby causing the on-off switch to be switched "on". The control circuit will again send a command signal to the signal means to cause it to be activated, typically giving only two beeps and/or two flashes. This enables the pharmacist to ensure that the cap is working properly. The cap is left attached to the vial, and the unit is given to the user.

After the pharmacist has given the medicine to the user, the user will, at some time, open the vial for the first time, switching the on-off switch "off". The user will remove one or more pills and will again screw the cap onto the vial, switching the on-off switch "on". The control circuit will sense this third "cycling" of the on-off switch, and will at that time begin timing its pre-programmed time period. At the end of its pre-programmed time period, the control circuit 25 will generate a control signal to the signal driving means 30 and the signal driving means will cause the signal means to beep and/or flash until the user opens the vial, thereby switching the on-off switch "off". The user will then retrieve from the vial and then replace the cap onto the vial, causing the on-off switch to be switched "on" which, in turn, causes the control circuit to start timing its pre-programmed time period. All time periods are substantially equal and are predetermined and pre-programmed in the control circuit 25.

When, at the end of every subsequent cycle, the user replaces the cap back onto the vial, the on-off switch will be switched "on" causing the initiation of timing, and the control circuit will again be enabled to command signaling at the end of the next time period. When the end of each time period is reached, a control signal will cause the signal means to signal until the patient removes the cap.

Therefore, the first two cyclings of the on-off switch (first by the assembler and then by the pharmacist) will only cause the signal means to emit a short signal (typically two beeps or flashes) to enable the assembler or pharmacist to verify that the cap is working properly. The third cycling will be the first time the user obtains his or her medicine, and the cycling of the switch during this usage will start the first timing cycle at the end of which signaling will occur. All subsequent cyclings will cause the signal means to emit the signal until the cap is removed from the vial, opening the on-off switch.

Operation of the system can be ascertained from the timing diagram of FIG. 5. In the timing diagram of FIG. 5, time starts at the left and proceeds to the right. The timing diagram shows the operation of five operational elements: (1) power from the power source as shown in FIG. 5(*a*); (2) the state of the switch, being either open or closed depending on whether the cap is respectively open or closed, as shown in FIG. 5(*b*); (3) the state of the timer where, for each timing cycle, the timer starts and times its preprogrammed time interval, triggering the control circuit to command signaling when the end of the time interval is, as shown in FIG. 5(*c*); (4) the control circuit means command signal, which is either not being commanded or is being commanded to the signal means, as shown in FIG. 5(*d*); and (5) the state of the signal means, which is either not emitting its signal(s) or is emitting its signal(s), as shown in FIG. 5(*e*).

Beginning at time t0, when the power source is first applied to the system, the system is made operational and the control circuit means 25 resets itself to its initial state. At a subsequent time t1 to t2, the assembler will cycle the switch by placing the cap on a jig or by manually cycling the switch with a finger or tool. When the switch is cycled from open to closed, the control circuit senses this initial closing of the switch 20 and transmits a short command signal at time t1 to the signal means such that the signal means will emit a short verification signal, audible and/or visual, to enable the assembler to verify that the system is operating normally.

At a later time, typically after the cap is shipped to a pharmacy, a pharmacist or technician will place the cap on a container containing a medicine to be dispensed to a customer. The placement of the cap on the container causes the switch to close at time t3. The control circuit means senses the closure of the switch at time t3 and transmits a short command signal to the signal means causing the signal means to emit only a short verification signal, enabling the pharmacist to verify that the cap is operating normally. The closed container containing the medicine is then stored for a time until it is transmitted to the customer/user. At some later time, the user will open the cap to retrieve his/her first dose of medicine. The time t4 indicates the time when the user first opens the container and the time t5 indicates the time when the user replaces the cap on the container.

At time t5, the control circuit has sensed the opening of the switch at time t4 and the closing of the switch at time t5. The control circuit causes its timing circuit (not shown) to begin timing a pre-set time interval starting at time t5. From time t5 to time t6, the timing circuit times the pre-set time interval and, at time t6, which is the end of the pre-set time interval, the timing circuit causes the control circuit 25 to transmit a command signal to the signal driver means 30 which, in turn, causes the signal means 35 and 40 to begin to continuously emit their normal signals. At some time after signaling begins, the user will hear and/or see the signal emitted by the cap, and will open the cap at time t7 to obtain the next dose of medication. The opening of the cap will cause the switch to open. The control circuit 25 senses the opening of the switch at time t7 and ceases sending the command signal to the signal driver means 30, thereby causing the signal emitted by the signal means 35 and 40 to stop.

After obtaining the medication, the user will replace the cap on the container at time t8, thereby causing the switch 20 to be closed. The control circuit 25 senses the closing of the switch 20 and causes the timing circuit within the control circuit 25 to again begin timing its pre-set time interval. This is the normal interval which repeats until the cap is disposed of, or until the power source no longer provides sufficient power to operate the system. By this means, the user receives a signal from the cap at the pre-set time interval, which signaling continues until the user opens the cap to retrieve the next dose of medicine. The user is reliably summoned at the desired intervals, and does not need to remember to check to see if it is time to take the next dose.

Two subsequent cycles are shown. At the next subsequent cycle, the end of the time interval at t9 causes the timer in the control circuit to trigger the control circuit to command the signal driving means to drive the signal means to signal. After hearing and/or seeing the signal, the user will remove the cap at time t10, opening the switch. The opening of the switch is sensed by the control circuit, which in turn ceases commanding signaling. The user will retrieve his or her medicine and then replace the cap. Replacement of the cap at time t11 causes the switch to again close. The closing of the switch at time t11 is sensed by the control circuit which causes its timer to again begin timing its pre-programmed time interval. This next time interval ends at time t12 whereupon signaling occurs. The user again opens the cap at time t13, causing the signaling to cease. When the user replaces the cap at time t14, timing is again started. These cycles continue until the vial and cap are no longer needed.

When the medicine dispensed by the pharmacist has been completely consumed or is no longer desired, the user may throw away the container and the cap. If the user might be bothered by further beeping or flashing from the cap (as when the cap may reside in the user's trash receptacle for a period of days), the user may simply remove the cap from its container before disposing of them. The switch 20 will then remain open and no further signaling will occur.

Although the invention has been particularly described with reference to the preferred embodiment illustrated in drawing figures, the invention is not so limited. Equivalents may be employed and substitutions made herein without departing from the scope of the invention as recited in the following claims. The scope of the invention is meant to be limited only by the following claims.

I claim:

1. A removable cap for a vial containing a medicinal or pharmaceutical substance comprising:

(1) a driving circuit for driving a signal means comprising one or more of an audible signal and a visible signal;

(2) an on-off switch disposed on a part of the cap that closely contacts the vial when the cap is attached to the vial;

(3) a control circuit, sensing the opening and closing of the cap with an on-off switch, wherein the control circuit commands the driving circuit to cause an acknowledgement signal when it senses the first and the second cycling of the on-off switch, and wherein, after the control circuit senses the third cycling of the on-off switch, the control circuit begins timing predetermined fixed time intervals and, at the end of each such predetermined fixed time interval, the control circuit commands the driving circuit to drive the signal means to emit its alert signal until such time that the on-off switch is opened; and (4) a source of power for powering the control circuit and the driving circuit.

2. The removable cap of claim 1 wherein, after the on-off switch is opened, the driving circuit ceases driving the signal means and, thereafter, when the on-off switch is again closed, the control circuit begins timing the next time interval and is enabled to command the drive circuit to emit its alert signal whenever the next subsequent predetermined fixed time interval has elapsed.

3. An openable or removable cap for closing an opening in an open container containing a medicinal or pharmaceutical substance, the cap comprising a cap body enclosing substantially within it:

(1) at least one signal means for signaling a user;

(2) a signal driver means connected to each signal means for driving the signal means;

(3) a sensing and control means comprising (a) a switch means, disposed on a surface of the cap, for sensing the opening and closing of the cap on the container, and, (b) a control means, connected to and driven by the switch means, (i) for commanding the signal driver means to immediately cause an acknowledgement signal when the switch means senses the first opening and closing of the cap;

(ii) for commanding the signal driver means to immediately cause an acknowledgement signal when the switch means senses the second opening and closing of the cap; and (iii) thereafter, for timing pre-set time intervals, with the opening and closing of the cap causing the control means to start timing the pre-set time interval; and, at the end of each pre-set time interval, for commanding the means for driving the signaling means to drive the signaling means; and (4) a source of power for the control means and the means for driving the signaling means.

4. The cap of claim 3 wherein the at least one signal means for signaling a user comprises an audible signal.

5. The cap of claim 3 wherein the at least one signal means for signaling a user comprises a visible signal.

6. The cap of claim 3 wherein the at least one signal means for signaling a user comprises an audible signal and a visible signal.

7. A means for closing a container, the means for closing comprising:

(a) a signal means for emitting at least one of an audible and visible signal to a person;

(b) a control circuit means for timing a predetermined fixed time interval and then commanding the signal means to emit its signal, the control circuit including a switch means disposed at a suitable location on the cap for sensing the opening and closing of the cap:

(c) a power source for providing power to the signal means and the control circuit means, (d) wherein, after power is first applied and the switch means is cycled the first time, the control circuit means will command the signal means to emit a short verification signal; when the switch is cycled the second time, it will again command the signal means to emit a short verification signal; and after the switch is cycled twice, thereafter when the switch is opened and closed, the control circuit means will begin timing its predetermined fixed time interval and, at the end of every interval, the control circuit means will command the signal means to emit its normal signal to alert the user that it is time to take his or her medication and, after the switch is opened or closed, the control circuit means will immediately start timing the next predetermined fixed time interval.

8. The means for closing a container of claim 7 wherein, removal of the cap from the container opens the switch means which, in turn, causes the control circuit means to command the signal means to cease any signaling.

9. The means for closing a container of claim 8 wherein, replacement of the cap on the container closes the switch means and enables the control circuit to command the signal means to emit its normal signal at the end of the next predetermined fixed time interval.

* * * * *